US007862394B2

(12) United States Patent
Larson et al.

(10) Patent No.: US 7,862,394 B2
(45) Date of Patent: Jan. 4, 2011

(54) APPARATUS HAVING A BUOYANT STRUCTURE THAT RESISTS ROTATION

(75) Inventors: Roger C. Larson, East Bridgewater, MA (US); Nicholas L. Flacco, Calabasas, CA (US); Gregory B. Hunter, Wrentham, MA (US)

(73) Assignee: Ultra Electronics Ocean Systems, Inc., Braintree, MA (US)

( * ) Notice: Subject to any disclaimer, the term of this patent is extended or adjusted under 35 U.S.C. 154(b) by 3 days.

(21) Appl. No.: 12/422,617

(22) Filed: Apr. 13, 2009

(65) Prior Publication Data

US 2009/0286432 A1 Nov. 19, 2009

Related U.S. Application Data

(60) Provisional application No. 61/053,172, filed on May 14, 2008.

(51) Int. Cl.
*B63B 22/22* (2006.01)

(52) U.S. Cl. ..... 441/30; 348/81

(58) Field of Classification Search ..... 441/30; 348/81

See application file for complete search history.

(56) References Cited

U.S. PATENT DOCUMENTS 3,093,808 A 6/1963 Tatnall et al.
3,258,595 A 6/1966 Galante
3,500,209 A 3/1970 Fletcher et al.
4,353,071 A 10/1982 Bernstein et al.
4,675,686 A * 6/1987 Robinson et al. ..... 343/709
4,794,575 A 12/1988 Miller
5,018,852 A 5/1991 Cheng et al.
5,060,206 A 10/1991 DeMetz, Sr.
5,543,972 A 8/1996 Kamewada
5,579,285 A * 11/1996 Hubert ..... 367/133
5,661,294 A 8/1997 Buchmann et al.
5,690,041 A 11/1997 Hillenbrand et al.
5,973,733 A 10/1999 Gove
6,525,762 B1 2/2003 Mileski et al.
6,532,037 B1 3/2003 Shimura
6,711,095 B1 3/2004 Daniels
6,731,845 B1 5/2004 Gerdt (Continued)

FOREIGN PATENT DOCUMENTS

JP 11298884 10/1999

(Continued)

*Primary Examiner*—Stephen Avila
(74) *Attorney, Agent, or Firm*—Daly, Crowley, Mofford & Durkee, LLP

(57) ABSTRACT

Apparatus includes a buoyant structure having a central vertical axis when floating in water and having at least one feature to reduce a rotation of the buoyant structure about the central vertical axis when floating in the water. The apparatus further includes an electronic camera assembly coupled to the buoyant structure. The electronic camera assembly is configured to generate an electronic image signal. The apparatus further includes a tubular structure coupled to the buoyant structure and configured to remain under the surface of the water. The tubular structure includes a watertight compartment and an electronic circuit assembly disposed within the watertight compartment. The electronic circuit assembly is coupled to receive the electronic image signal and is configured to generate an optical image signal representative of the electronic image signal. The apparatus further includes a fiber optic cable configured to carry the optical image signal.

28 Claims, 11 Drawing Sheets

U.S. PATENT DOCUMENTS

| | | | | |
|---|---|---|---|---|
| 7,230,881 | B2 | 6/2007 | Howard et al. | |
| 7,279,675 | B2 | 10/2007 | Cohen | |
| 7,345,705 | B2 * | 3/2008 | Croasdale | 348/335 |
| 2002/0006000 | A1 | 1/2002 | Kumata et al. | |
| 2003/0007795 | A1 | 1/2003 | Grober | |
| 2003/0146974 | A1 * | 8/2003 | Murphy | 348/143 |

FOREIGN PATENT DOCUMENTS

| | | |
|---|---|---|
| JP | 2007-312270 | 11/2007 |

* cited by examiner

APPARATUS HAVING A BUOYANT STRUCTURE THAT RESISTS ROTATION

CROSS REFERENCE TO RELATED APPLICATIONS

This application claims the benefit under 35 U.S.C. §119 (e) of U.S. Provisional Application No. 61/053,172 filed May 14, 2008, which application is incorporated herein by reference in its entirety.

STATEMENT REGARDING FEDERALLY SPONSORED RESEARCH

Not Applicable.

FIELD OF THE INVENTION

This invention relates generally to buoys and, more particularly, to a buoy to which an electronic camera assembly is coupled, wherein the buoy has characteristics to reduce a motion of the buoy to provide a stable camera image.

BACKGROUND OF THE INVENTION

Many types of flotation devices exist with differing characteristics.

Damper plates and toroid shaped flotation devices have been used to create buoys in the form of so-called "wave follower" buoys. For example, see Buoy Engineering, H. O. Berteaux, John and Sons, 1976 Pg. 212-213. Wave follower buoys are subject to relatively small amounts of motion relative to the motion of the ocean surface that they follow. However, in the presence of waves, the wave follower buoy experiences a relatively large amount of absolute heave and pitch due to the heave and pitch of the wave surfaces.

A so called "spar buoy" has less absolute heave and pitch as it tends to have a smaller cross section at the water level than a wave follower buoy, but unless the spar buoy has substantial length it will submerge in larger waves. Mass of the spar buoy can also be distributed to create a righting moment. This will decrease absolute pitch. However, spar buoys tend to experience large amounts of rotation about a central vertical axis, vertically oriented relative to the surface of the water.

An object suspended beneath a spar buoy in the presence of waves has a tendency to increase the absolute pitch, roll, and heave of the spar buoy.

It would be desirable to provide a buoy having reduced amounts of rotation about a central vertical axis than a spar buoy in some applications.

SUMMARY OF THE INVENTION

The present invention provides a floating platform to carry an electronic camera assembly configured to provide an image. The floating platform has enough stability in six degrees of motion, including in azimuth rotation, to allow the image generated by the electronic camera assembly to be stable.

In accordance with one aspect of the present invention, apparatus includes a buoyant structure having a central vertical axis when floating in water and having at least one feature to reduce a rotation of the buoyant structure about the central vertical axis when floating in the water. The apparatus further includes an electronic camera assembly coupled to the buoyant structure. The electronic camera assembly is configured to generate an electronic image signal. The apparatus further includes a tubular structure coupled to the buoyant structure and configured to remain under the surface of the water. The tubular structure includes a watertight compartment and an electronic circuit assembly disposed within the watertight compartment. The electronic circuit assembly is coupled to receive the electronic image signal and is configured to generate an optical image signal representative of the electronic image signal. The apparatus further includes a fiber optic cable coupled to the electronic circuit assembly and configured to carry the optical image signal.

In some embodiments, the at least one feature to reduce a rotation of the buoyant structure comprises a virtual mass of water disposed proximate to an outer sidewall of the buoyant structure. In other arrangements, the at least one feature comprises a fin member coupled to a least one of the buoyant structure or the tubular structure.

BRIEF DESCRIPTION OF THE DRAWINGS

The foregoing features of the invention, as well as the invention itself may be more fully understood from the following detailed description of the drawings, in which.

DETAILED DESCRIPTION OF THE INVENTION

Before describing the present invention, some introductory concepts and terminology are explained. As used herein, the term "buoyant" is used to describe an object for which, when floating in a liquid, a buoyant force acting upward upon a center of buoyancy of the object is greater than a force of gravity acting downward upon a center of mass of the object. In other words, the object tends to float in the liquid. The force of gravity can include a force of gravity of a submerged object suspended beneath and coupled to the buoyant object and the center of mass can be a combined center of mass of the buoyant object and the submerged object.

As used herein, the term "virtual mass" is used to describe an entrained volume of water (or other liquid), which fills or partially fills a cavity upon the below-described apparatus when the below-described apparatus is in water. The virtual mass, being entrained, has inertia. The virtual mass can fill and drain from the apparatus as the buoy heaves and at a relative rate relative to a wave period.

As will be understood, the apparatus can have a particular center of mass at a particular position (and relative to the water surface), and the apparatus can have a different "virtual center of mass" at a different particular position (and relative to the water surface).

It will also be understood that motion can be described as having six degrees, linear motion along three orthogonal axes and rotational motion about each of the three orthogonal axes. In general, the three orthogonal axes are fixed relative to the earth. The linear displacement motions are sometimes referred to as heave, sway, and surge. The rotational motions are sometimes referred to as pitch, roll and yaw. As used herein, the term "azimuth rotation" will be understood to be the same as yaw when two axes of the fixed coordinate system are horizontal.

Figure 1:
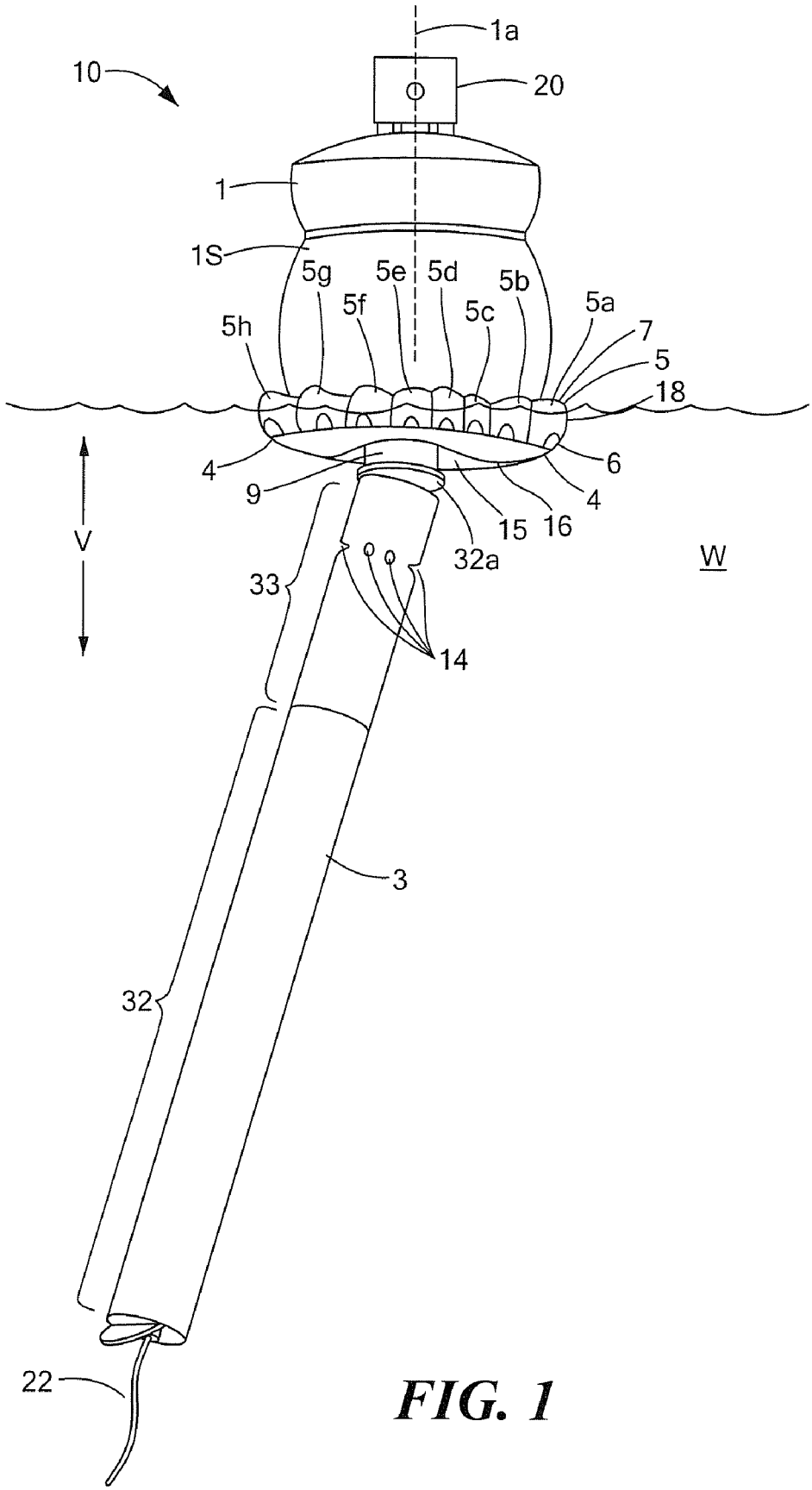
FIG. 1 is a side view of an exemplary apparatus according to the invention deployed in water and having a buoyant structure, an electronic camera assembly, and a tubular structure.
Figure 2:
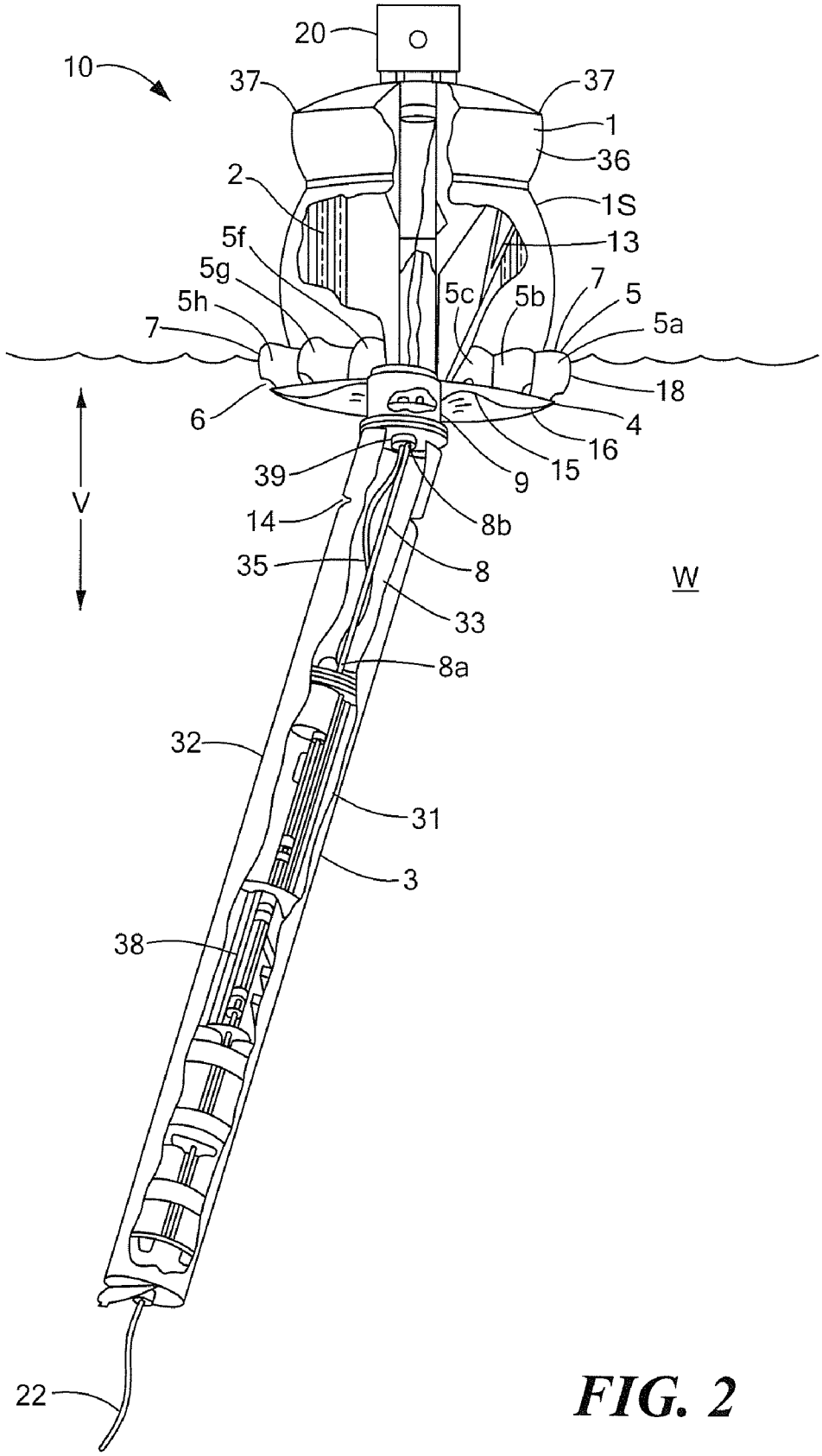
FIG. 2 is a side view of the apparatus of FIG. 1 with parts broken away to illustrate internal structure.

Referring now to FIGS. 1 and 2, in which like elements have like reference designations, an apparatus 10 includes a buoyant structure 1 having a central vertical axis la when floating in water, W. The buoyant structure 1 has at least one feature to reduce a rotation of the buoyant structure 1 about the central vertical axis 1 a when floating in the water. The at least one feature to reduce the rotation is described more fully below. The apparatus also includes an electronic camera assembly 20 coupled to the buoyant structure 1. The electronic camera assembly 20 is configured to generate an electronic image signal described more fully below in conjunction with FIG. 7. The apparatus also includes a tubular structure 3 coupled to the buoyant structure 1 and configured to remain under the surface of the water, W. The tubular structure 3 includes a watertight compartment 32 and an electronic circuit assembly 31 disposed within the watertight compartment 32. The electronic circuit assembly 31 is coupled to receive the electronic image signal. The electronic circuit assembly 31 is configured to generate an optical image signal representative of the electronic image signal. The apparatus also includes a fiber optic cable 22 coupled to the electronic circuit assembly 31 and configured to carry the optical image signal.

The assembly can also include a battery 36 coupled to power at least the electronic circuit assembly 31.

In some embodiments, the electronic image signal and the optical image signal are representative of still images, e.g., snapshots, taken by the electronic camera assembly 20. In other arrangements, the electronic image signal and the optical image signal are representative of video images, e.g., moving images, taken by the electronic camera assembly 20.

In some embodiments, the electronic image signal and the optical image signal are representative of images of visible light taken by the electronic camera assembly 20. In other arrangements, the electronic image signal and the optical image signal are representative of images of infrared light taken by the electronic camera assembly 20. In some embodiments, the electronic image signal and the optical image signal are representative of images of both visible light and infrared taken by the electronic camera assembly 20

The tubular structure can also include a compartment 33 configured to flood with water, W. To this end, the compartment 33 can have holes 14.

In some embodiments, the buoyant structure 1 is an inflatable bag 1 in the form of an inflated balloon-like structure having a specific gravity less than the specific gravity of the water, W. In some embodiments, the inflatable bag 1 has a concave bottom 16. The inflatable bag 1 supports the tubular structure 3 below a surface of water, W, which tubular structure 3 would otherwise sink.

Figure 9:
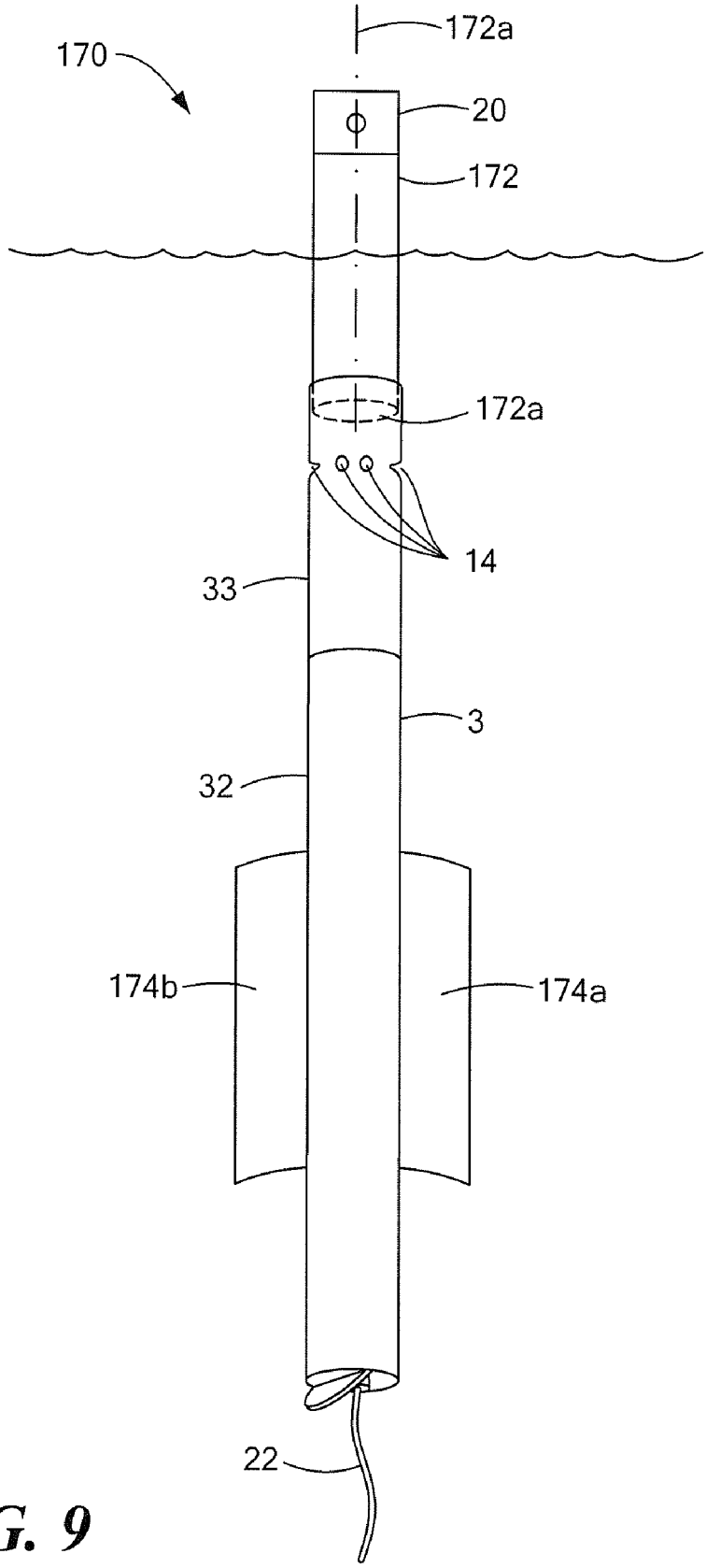
FIG. 9 is a side view of another exemplary apparatus according to the invention deployed in water and having a different buoyant structure, the electronic camera assembly, and the tubular structure.

Although, in the apparatus 10, the buoyant structure 1 comprises the inflatable bag 1, in other embodiments, the buoyant structure 1 can be a flotation device of any type. Another exemplary embodiment is shown in FIG. 9.

In some embodiments, the inflatable bag 1 includes a damper skirt 4 that extends around the base of the inflatable bag 1 in a direction approximately perpendicular to the central vertical axis la, i.e., essentially horizontally. The damper skirt 4 can be made of a semi-rigid material. The damper skirt 4 can be supported by a ribbon fence 5. The ribbon fence 5 can form a plurality of compartments, e.g., **5*a*-5*h*, which plurality of compartments may also include compartments (not shown) around the backside of the inflatable bag 1. The ribbon fence 5 is described in greater detail below in conjunction with FIG. 4**.

When the apparatus 10 is floating in the water, W, the damper skirt 4 is below the surface of the water, W. The in-water weight of the tubular structure 3 and the buoyancy of the inflatable bag 1 are configured so that the damper skirt 4 is below the surface of the water, W.

The damper skirt 4 provides a surface having a surface area in contact with the water, W, which surface resists vertical motion, V, within the water, W. In order to move vertically (heave) or tip (pitch and/or roll) relative to the surface of the water, W, in response to a wave in the water, W, the damper skirt 4 or a part of the damper skirt 4 must travel vertically through the water, W. A resistance to vertical movement of the damper skirt 4 is provided by the water above and/or below the damper skirt 4. Wave energy that would otherwise cause relative heave and/or pitch and roll of the inflatable bag 1 relative to the surface of the water, W, is dissipated by this resistance against vertical movement of the damper skirt 4 within the water, W. In essence, the inflatable bag 1 tends to follow the up and down (heave) and angular (pitch and roll) motion of waves. The buoyant structure 1 thus represents a so-called wave follower buoy.

It should be recognized that waves tend to have relatively small surface angles, for example, on the order of ten to fifteen degrees. Thus, the pitch and roll of a wave follower buoy are limited.

Figure 3:
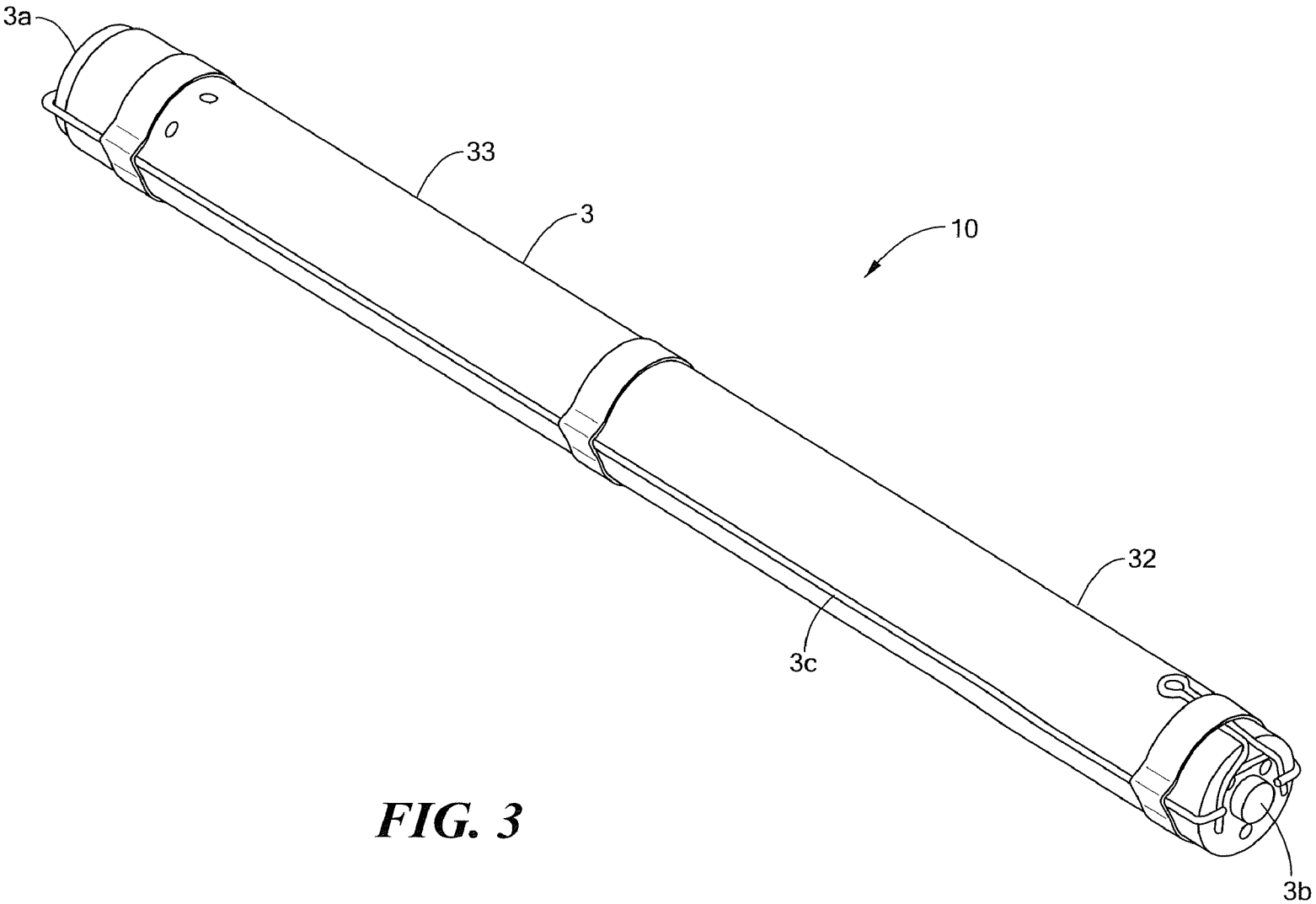
FIG. 3 is a perspective view of the apparatus of FIG. 1 in an un-deployed (stowed) state, wherein the buoyant structure and the electronic camera assembly are stowed within the tubular structure.

Referring now to FIG. 3, when in a stowed configuration, the apparatus 10 of FIGS. 1 and 2 can be fully contained within the tubular structure 3. Upon deployment, the inflatable bag 1 can inflate, for example, by way of a gas bottle (FIG. 5), and deploy from a first end **3*a* of the tubular structure 3, and the fiber-optic cable 20 can deploy from a spool or the like from a second end 3***b* of the tubular structure. To this end, a rod 3*c* can hold the ends 3*a*, 3*b* (e.g., end caps) in a sealed condition prior to deployment, and the rod 3*c* can be released, for example, by way of a pyrotechnic device, therefore unsealing the ends 3*a*, 3*b* upon deployment.

Figure 4:
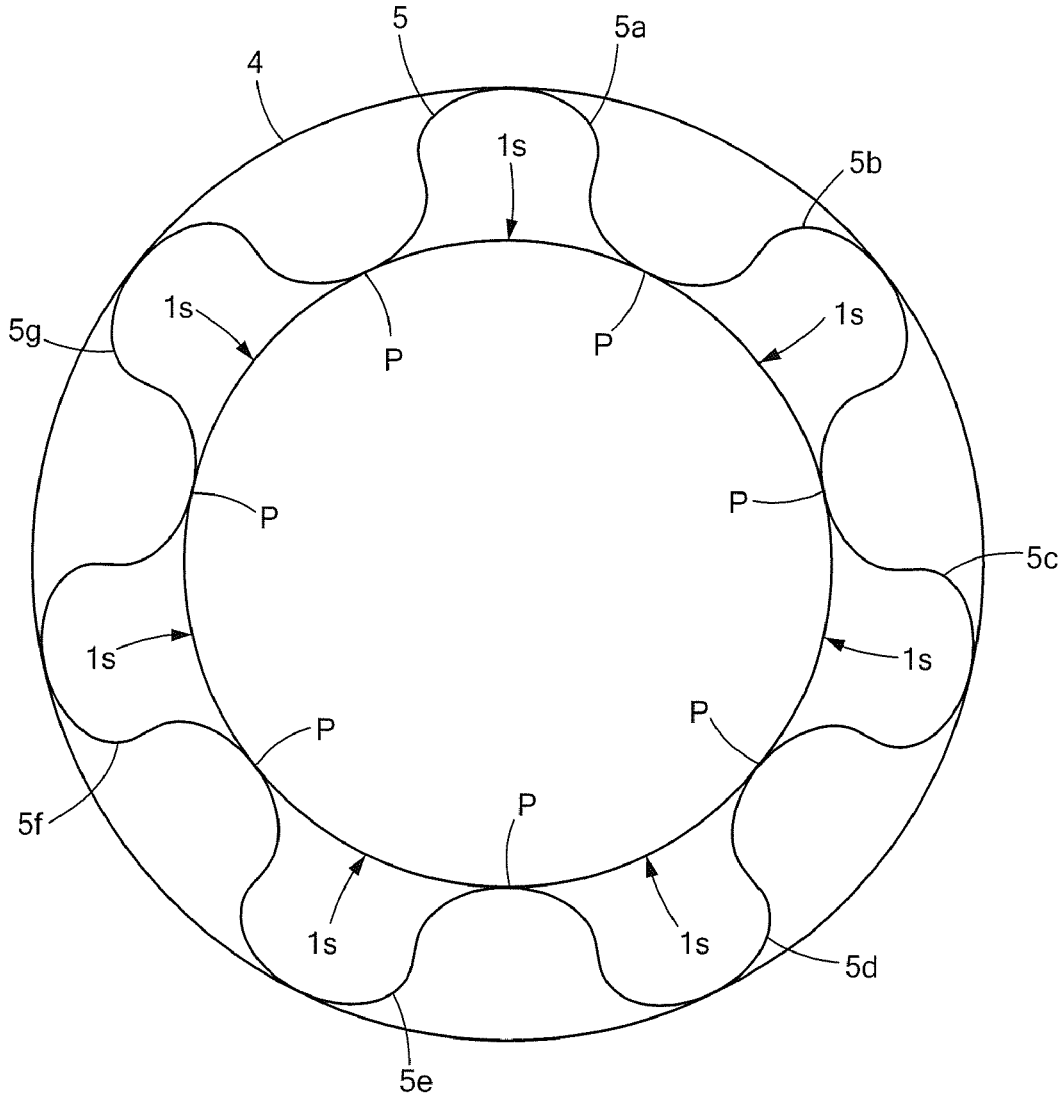
FIG. 4 is a top view of the buoyant structure of the apparatus of FIG. 1.

Referring now briefly to FIG. 4, the ribbon fence 5, which is coupled to the damper skirt 4, includes a plurality of compartments, e.g., compartments 5*a*-5*g*. Each one of the compartments is bounded by the damper skirt 4, by the ribbon fence 5, and by the outer sidewall 1*s* of the inflatable bag 1. The ribbon fence 5 can be formed from a semi-rigid material connected to the outer sidewall is of the inflatable bag 1 at spaced apart attachment regions P. Any number of compartments can be formed, including but one circumferential compartment with no attachment regions P.

Referring again to FIGS. 1 and 2, each compartment 5*a*-5*h*, e.g., the compartment 5*a*, has an opening (or bottom hole) 6 in the lower portion thereof, proximate to where the ribbon fence 5 couples to the damper skirt 4. Each compartment 5*a*-5*h*, e.g., the compartment 5*a*, has an open top 7. When stable in the ocean, the bottom hole 6, which has a cross section less than the opening at the top 7, is beneath the surface of the water, W, and the open top 7 can be above the surface. In some arrangements, the water line on the inflatable bag 1 when the apparatus is at rest in the ocean is approximately at a midpoint of the height of the ribbon fence 5.

Compartments 5*a*-5*h* act as containers for the water, W, partially entraining water, and therefore, forming a virtual mass. Taking the compartment 5*a* as representative of the other compartments 5*b*-5*h*, fluid can enter the compartments 5*a* through the hole 6 or the open top 7 and can drain from the compartment 5*a* through the hole 6. The hole 7 is sized in relation to a period of surface waves so that the ribbon fence 5 generally retains water.

When the inflatable bag 1 rises due to the motion of the water, some water tends to drain out of the holes, e.g., the hole 6, dissipating kinetic energy of the inflatable bag 1 created by the rising motion of the ocean. Vertical motion of the inflatable bag 1 relative to the surface of the water, W, is thereby reduced.

The compartments 5*a*-5*h* can further increase the resistance to vertical motion of the inflatable bag 1 relative to the surface of the water, W, by partially enclosing the water, W, and therefore, forming the virtual mass. The virtual mass essentially requires the damper skirt 4 to vertically move the virtual mass of water within the compartments 5*a*-5*h* as the inflatable bag 1 otherwise attempts to move vertically relative to the surface of the water, W, in response to a wave. The virtual mass has inertia, which acts to further decrease the heave and pitch (and/or roll) of the inflatable bag 1 relative to the surface of the water, W.

Furthermore, the virtual mass of water entrained in the compartments 5*a*-5*h* provides the above-described at least one feature configured to reduce a rotation of the buoyant structure 1 about the central vertical axis 20 when floating in the water, W. The virtual mass provides an inertia spaced out from the central vertical axis 20. That inertia resists rotation by any force causing a torque about the central major axis 20. In some arrangements, an outer largest diameter of the ribbon fence is about fourteen inches, and a diameter of the sidewall Is of the inflatable bag 1 is about ten inches.

Furthermore, with regard to rotation, the ribbon fence 5, being spaced apart from the central vertical axis 1*a* by a relatively large amount, and also, therefore, having a relatively large surface area in contact with the water, W, also tends to reduce a rotation of the buoyant structure about the central vertical axis 1*a* due to surface tension and drag upon the surface of the ribbon fence 5 if rotation were to occur.

It should be understood that rotation about the central vertical axis 1*a* is not precisely the same as yaw or azimuth rotation, both of which generally refer to a fixed coordinate system. Instead, the central vertical axis 1*a* can move as the buoyant structure 1 moves angularly due to wave motion. However, reduction of rotation about the central vertical axis 1*a* does tend to reduce yaw or azimuth rotation of the buoyant structure 1.

The damper skirt 4 and ribbon fence 5 are described to be associated with each other, each constructed from semi-rigid materials for the purpose of stabilizing the inflatable bag 1, when in the presence of waves. However, in other arrangements, the damper skirt 4 is a submerged damper plate and the ribbon fence 5 is not used. The damper plate alone can also decrease both the heave and pitch of the apparatus 10 relative o the surface of the water, W.

The tubular structure 3 comprises the electronics circuit assembly 31 enclosed in a watertight compartment 32. In some embodiments, the tubular structure 3 is coupled to the bottom of the buoyant structure 1 by a nylon cord 8. One end of the nylon cord 8 can connect to a point 8*a* within the tubular structure 3 approximately one-quarter from the top of the tubular structure 3 and the other end can connect to a center of a bulkhead 9, which is a rigidly coupled to the inflatable bag 1. Electrical wires 35 pass from the electronics circuit assembly 31 into and though the bulkhead 9 and into the inflatable bag 1. Beneath the bulkhead 9 is a bumper 39.

The nylon cord 8 and the location of the couplings at 8*a* and 8*b* between the tubular structure 32 and the inflatable bag 1, decouple the motion of inflatable bag 1 from the tubular structure 3 such that, over a certain range, motion of inflatable bag 1 does not affect the motion of tubular structure 3 and the motion of the tubular structure 3 does not affect the motion of inflatable bag 1. The range of motion depends on the dimensions of the decoupling apparatus including the diameter of the tubular structure 3 and the distance between the top of the tubular structure 3 and bumper 39.

The tubular structure 3 is free to tilt until the top of the tubular structure 3 collides with the bumper 39. Similarly, the inflatable bag 1 can freely pitch and/or roll until the bumper 39 collides with the top 32*a* of the tubular structure 3.

In some arrangements, the tubular structure 3 can tilt relative to the inflatable bag 1 by at least ten to fifteen degrees before contact between the tubular structure 3 and the bumper 39. The bumper 39 absorbs some of the energy of an impact between the inflatable bag 1 and the tubular structure 3, decreasing the effect such impact would have on motions of the inflatable bag 1, and also preventing damage to the inflatable bag 1 that would otherwise result from direct impact between the inflatable bag 1 and the tubular structure 3. The bumper 39 also protects the electrical wiring 35 that feeds into the inflatable bag 1, preventing interruption or interference with electrical signals carried in the wires 35 due to impacts between the tubular structure and the bulkhead 9 through which wires 35 pass.

The compartment 33 of the tubular structure 3, also referred to herein as a collar, stores the entire buoyant structure 1 before it is deployed, as shown in FIG. 3. After deployment, the compartment 33 floods with water through holes 14. The flooding increases the in-water weight of the tubular structure 3, which results in the tubular structure 3 pulling the inflatable bag 1 into the water, ensuring that the damper skirt 4 and the bottom hole 6 of the ribbon fence 5 are submerged. As described above, this increases the stability of inflatable bag 1.

The flooding of the compartment 33 results in the center of mass of the tubular structure 3 being lower in the water, W, increasing the period of swing of the tubular structure 3 relative to the inflatable bag 1. This stabilizes the entire apparatus 10 and decreases the heave, pitch, and roll of the inflatable bag 1 relative to the surface of the water, W.

In some embodiments, the center 15 of the bottom 16 of the inflatable bag 1 is pulled upward by straps 13 secured at regions 36, along the inside wall of inflatable bag 1, resulting in the concave bottom 16. This reduces the buoyancy of inflatable bag 1, aiding in maintaining the waterline above the damper skirt 4 and approximately at the midpoint of the ribbon fence 5. The bottom 16 of the inflatable bag 1 can be upwardly arched at its center 15 so that the greatest buoyant forces are located at the outer portions of the inflatable bag 1. This shape decreases the pitch and roll of the inflatable bag 1 by creating a longer torque arm, which must be overcome for the inflatable bag 1 to pitch or roll. This righting moment further aids in stabilizing the inflatable bag 1. Furthermore, adhesion to the water, W, caused by the upwardly arched center 15 also tends to decrease the heave of the inflatable bag 1.

Although the apparatus 10 has the inflatable bag 1 with the concave bottom 16, in other embodiments, the buoyant structure 1 can be comprised of any material with a bottom having an upwardly arched shape.

Figure 5:
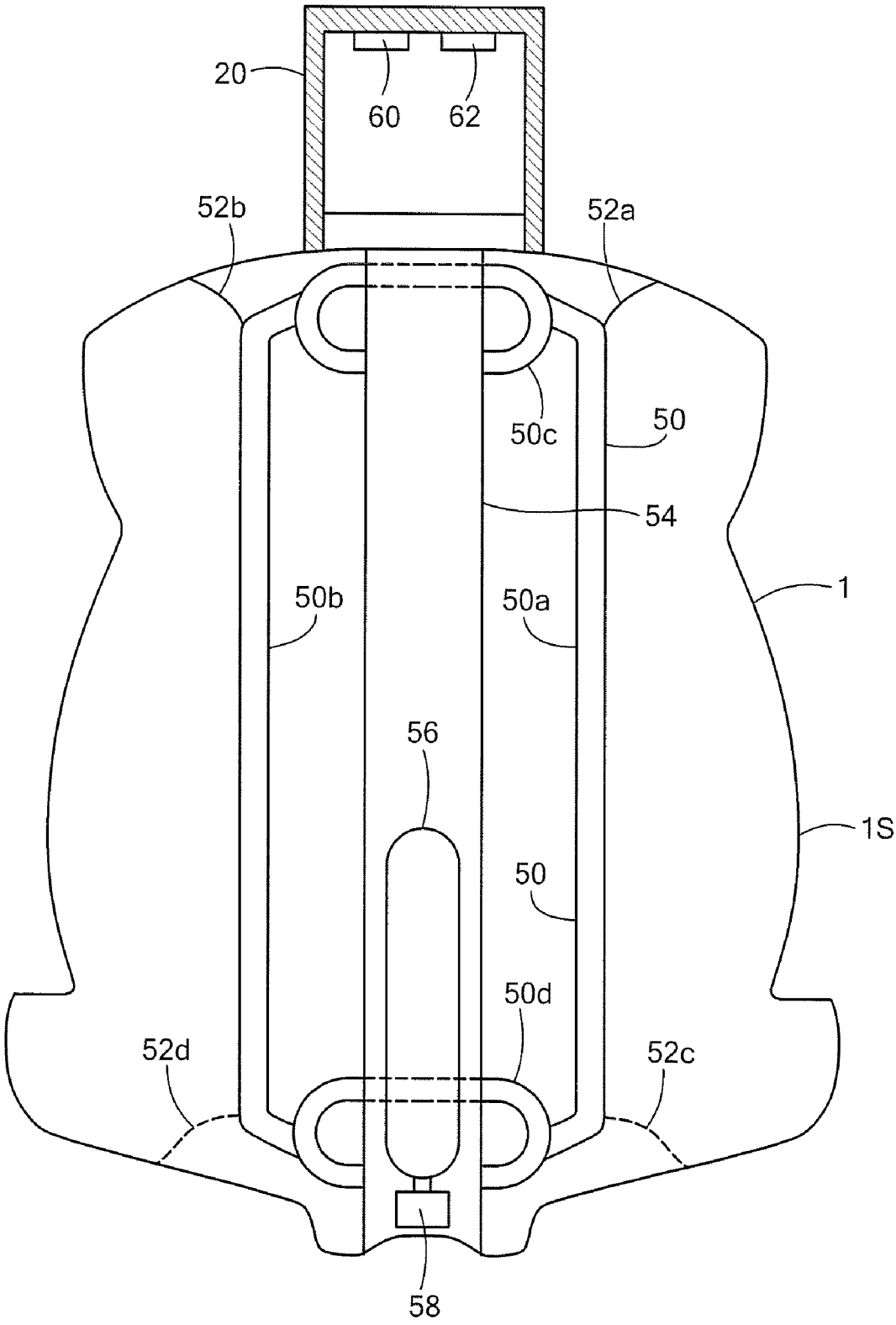
FIG. 5 is a side-sectional view of the buoyant structure of the apparatus of FIG. 1, showing five internal antennas, one of which includes an inflation mechanism.

Referring now to FIG. 5, in which like elements of FIGS. 1-2 are shown having like reference designations, the inflatable bag 1, here shown centrally sectioned, can include the electronic camera assembly 20 (FIGS. 1, 2) and also one or more of a UHF communication antenna 50 configured to operate with a predetermined gain, polarization elevation, and azimuth pattern in a frequency band associated with an ultra high frequency (UHF) radio, an Iridium antenna 60 configured to operate in a frequency band associated with an Iridium radio, an automatic identification antenna 56 configured to operate in a frequency band associated with an automatic identification system (AIS), a radar detection antenna 56 configured to operate in a frequency band associated with a radar detection system, or a global positioning antenna 62 configured to operate in a frequency band associated with a global positioning system (GPS).

In some embodiments, the antennas 60, 62 are patch antennas or arrays of patch antennas. In some embodiments, the radar detection antenna 56 and the AIS antenna 56 are comprised of a gas bottle 56 used to hold a gas, for example $CO_2$ to inflate the inflatable bag 1. An inflation mechanism 58 can puncture the gas bottle 56 upon deployment of the apparatus 10 (FIG. 1) thereby inflating the inflatable bag 1 and leaving the metal gas bottle 56 to act as an antenna.

In some embodiments, the UHF antenna 50 is a UHF satellite communications antenna having four vertical portions, only two of which 50*a*, 50*b* are shown, and having upper and lower joining portions 50*c*, 50*d*. In some embodiments, straps 52*a*-52*d* generate tension upon the vertical portions 50*a*-50*b*, holding them in a vertical orientation.

In some embodiments, the UHF antenna 50 is right circularly polarized and is comprised of conductors imprinted upon flex circuit material.

In order to operate in the above-described bands, the electronic circuit assembly 31 of FIG. 2 within the tubular structure 1 can include at least a portion of a respective at least one of an ultra high frequency (UHF) radio, an Iridium radio, an automatic identification system (AIS), a radar detection system, or a global positioning system (GPS). Other portions of these systems can be within the inflatable bag 1.

Figure 6:
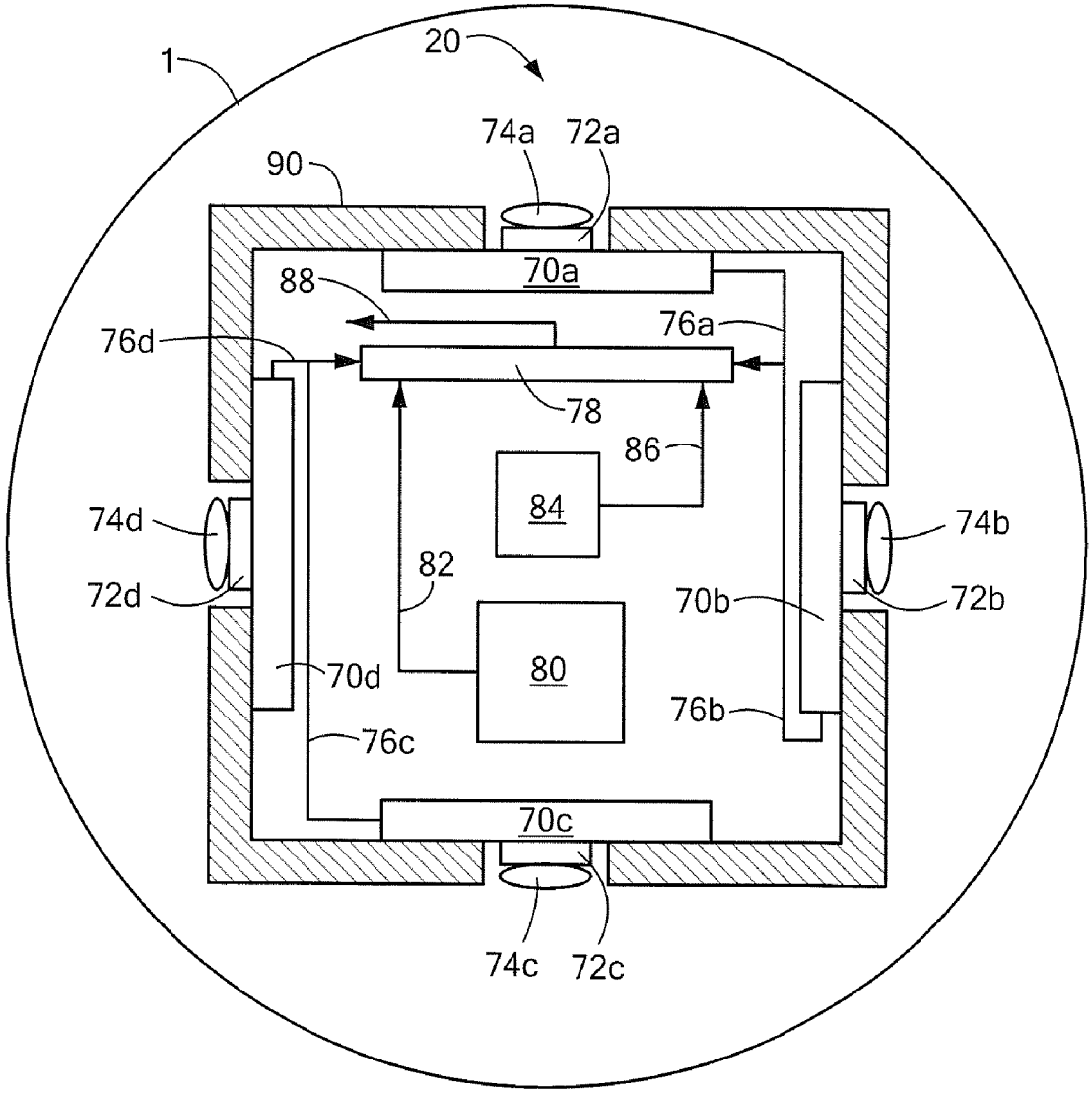
FIG. 6 is a top sectional view of the electronic camera assembly of the apparatus of FIG. 1, showing four electronic cameras, an inertial motion sensor, an electronic compass, and an image processor.

Referring now to FIG. 6, in which like elements of FIGS. 1 and 2 are shown having like reference designations, the electronic camera assembly 20 can include at least four electronic cameras 70*a*-70*d* mounted in a housing 90. The electronic cameras 70*a*-70*d* can have respective lenses 74*a*-74*d* disposed in front of respective charge coupled devices (CCDs) 72*a*-72*d*. The electronic cameras 70*a*-70*d* are coupled to an image processor 78, each providing a respective electronic camera signal 76*a*-76*d*. The electronic camera signals 76*a*-76*d* are each electronic image signals, and taken together are also referred to herein as an electronic image signal. The image processor 78 is configured to provide image stabilization to the electronic camera signals 76*a*-76*d* from each one of the plurality of electronic cameras 70*a*-70*d* as the buoyant structure 1 (FIG. 1) moves in at least one degree of motion.

As described above, each one of the electronic camera signals 76*a*-76*d* can be representative of still images or moving video images. Also, each one of the electronic camera signals 76*a*-76*d* can be representative of images of visible light, or infrared light, or of both.

As is known and as described above, motion can be described in terms of six degrees of motion; linear motion along three orthogonal axis and rotational motion bout each one of the three orthogonal axes. The image correction provided by the image processor 76 can provide image stabilization in one, two, three, four, five, or six degrees of motion.

The image processor 78 is also configured to combine processed signals representative of the electronic camera signals 76*a*-76*d* into an electronic image signal representative of a panoramic view azimuthally about the buoyant stricture 1. In some embodiments, the panoramic view is throughout three hundred sixty degrees in azimuth.

Each lens 74*a*, 74*d* has a focal length selected and/or each CCD has a number of pixels selected to achieve an azimuth viewing angle so that a ship at a horizon range from the apparatus 10 occupies at least one pixel associated with at least one of the plurality of cameras 70*a*-70*d*. In some embodiments, the focal length of each lens 74*a*-74*d* is about three millimeters. In some embodiments, each one of the CCDs 72*a*-72*d* has 350,000 pixels for each of three colors.

The electronic camera assembly 20 can also include an inertial sensor 84 coupled to provide an inertial signal 86 to the image processor 78. The electronic camera assembly 20 can also include an electronic compass 80, for example, a flux gate compass 80, coupled to provide a compass signal 82 to the image processor 78. The inertial signal 86 and the compass signal 82 can be used by the image processor 78 in order to provide the above-described image stabilization.

The image processor is configured to generate an optical image signal 88 carried by the optical fiber cable 22 of FIGS. 1 and 2. The optical image signal 88 can be representative of a stabilized and combined version of the electronic camera signals 76*a*-76*d*. In some embodiments, the optical image signal 88 is representative of a panoramic view about the apparatus 10 (FIGS. 1 and 2).

Figure 7:
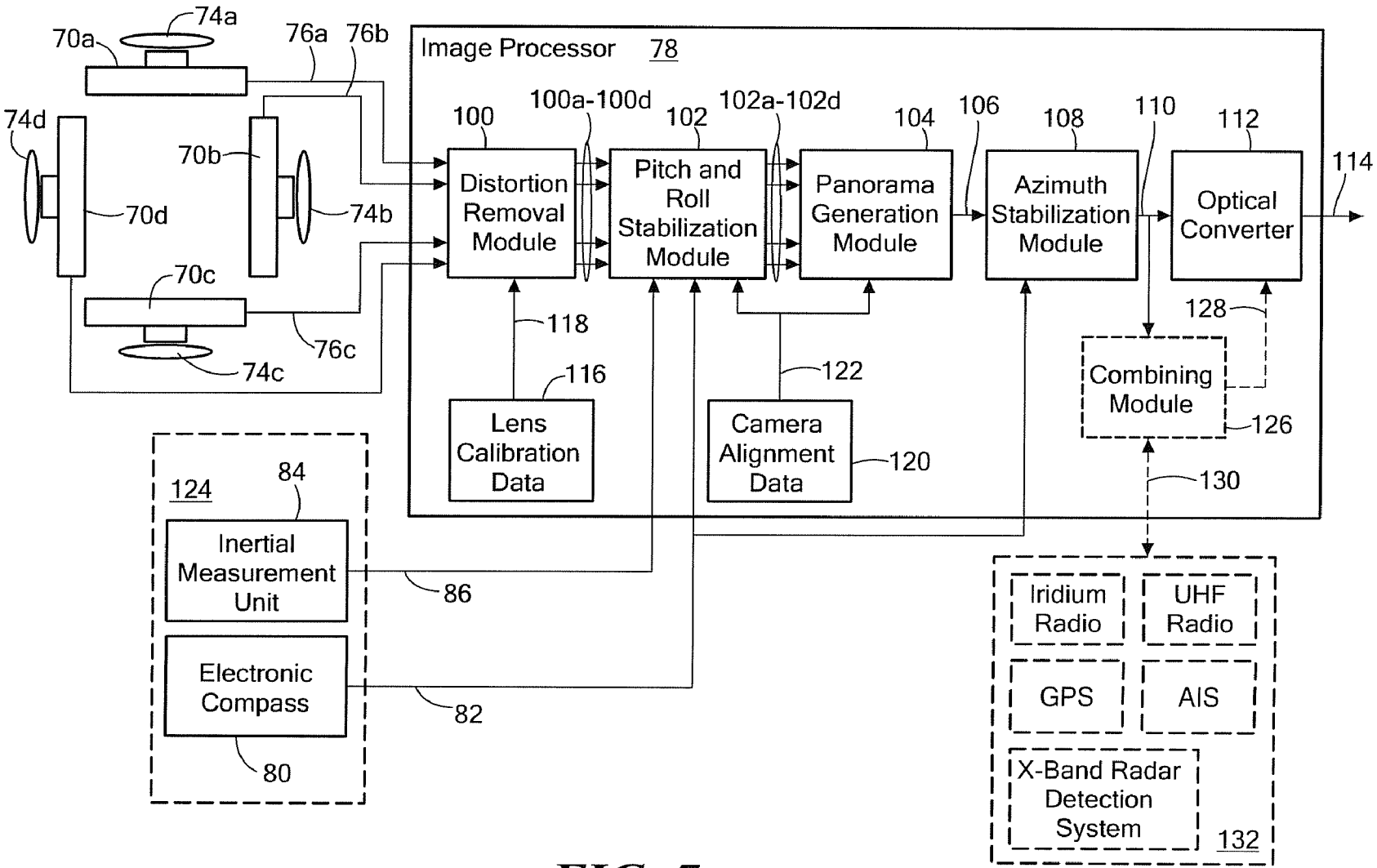
FIG. 7 is a block diagram showing the four electronic cameras, the inertial motion sensor, the electronic compass, and the image processor of FIG. 6.

Referring now to FIG. 7, in which like elements of FIG. 6 are shown having like reference designations, electronic cameras 70*a*-70*d* provide the signals 76*a*-76*d*, each of which is an electronic image signal, to the image processor 78, and more particularly, to a distortion removal module 100.

The distortion removal module 100 is configured to remove optical distortions primarily attributable to the lenses 74*a*-74*d*. To this end, the distortion removal module 100 can receive lens calibration data values 118 from a lens calibration data array 116 stored in a memory. The lens calibration data array 116 can be generated and stored at the time of manufacture of the electronic camera assembly 20 by one of a number of techniques know to one of ordinary skill in the art. The lens calibration values 116 can essentially reduce aberrations, improving the rectilinear nature of the scene so that vertical or horizontal lines, such as the horizon, are restored to straight lines in the output imagery.

The image processor 78 can also include a pitch and roll stabilization module 102 coupled to receive distortion corrected signals 100*a*-100*d* from the distortion removal module 100 and configured to generate pitch and roll stabilized signals 102*a*-102*d*. While shown as one module, the pitch and roll stabilization module 102 can include two separable portions. A first portion of the pitch and roll stabilization module 102 can receive the inertial measurement signal 86 from the inertial measurement unit 84 and the compass signal 82 from the electronic compass 80. With the inertial data 86 and with the compass data 82, the pitch and roll stabilization module 102 can coarsely adjust the lens calibrated signals 100*a*-100*d* to reduce apparent pitch, roll, and yaw (or azimuth) rotational movements of the electronic camera assembly 20 (FIGS, 1, 2, and 6).

In some embodiments, a second portion of the pitch and roll stabilization module 102 can also make finer corrections to reduce the apparent pitch, roll, and yaw (or azimuth) rotational movements of the electronic camera assembly 20. In some arrangements, the pitch and roll stabilization module 102 can automatically find and track features in the scene such as a horizon, for example, by contrast between the sky and the water, within the lens-calibrated signals 100*a*-102*d* and can make adjustments to the lens calibrated signals 100*a*-100*d* to keep the horizon and earth-fixed features stationary.

It should be understood that, once the images represented by the electronic camera assembly 20 are stabilized in pitch and roll, then the images are related to a fixed coordinate system, and the last rotation, which is referred to above as a mechanical rotation of the buoyant structure 1 (FIG. 1) about its central vertical axis la, results in yaw or azimuth rotation of the images.

A panorama generation module 104 can combine or stitch together the images represented by the pitch and roll stabilized signals 102*a*-102*d* to provide a panoramic signal 106 representative of a panoramic view about the electronic camera assembly 20. In some embodiments, the panoramic signal 106 is representative of a three hundred sixty degree panoramic view in azimuth about the electronic camera assembly 20.

The pitch and roll stabilization module 102 and the panorama generation module 104 can be coupled to receive camera alignment data values 122 from a camera alignment data array 120 stored in a memory. The camera alignment data values 122 can represent axial and rotational alignments of the four electronic camera assemblies relative to a coordinate system, for example, a Cartesian coordinate system.

An azimuth stabilization module 108 can further stabilize the panoramic signal 106 in azimuth to provide a stabilized panoramic signal 110. The azimuth stabilization module 108 can be coupled to receive the compass signal 82 and can be configured to adjust or stabilize the stabilized panoramic signal 110 according to compass rotations.

Without the above described at least one feature (e.g., the virtual mass within the compartments 5*a*-5*h*, FIG. 1) of the buoyant structure 1, which feature is configured to reduce a rotation of the buoyant structure 1, in particular in rotation about its central vertical axis, rotations of the buoyant structure 1 may be so rapid and so extreme that the various yaw (or azimuth) stabilizations described above may not be able to maintain azimuth stabilization of the stabilized panoramic signal 110. In particular, it ahs been recognized that a simple par buoy, not having the at least one feature, can rotate in azimuth hundreds of degrees per second.

The stabilized panoramic signal 110 can be received by an optical converter 112, which can convert the stabilized panoramic signal 110 to an optical stabilized panoramic signal 114. The optical stabilized panoramic signal 114 can be coupled to and carried by the fiber optic cable 122 of FIGS. 1 and 2.

In one particular embodiment, the optical stabilized panoramic signal 114 (i.e., the fiber optic cable 22) is coupled to a submarine (see, e.g., FIG. 13), in which case the assembly 10 of FIGS. 1 and 2 can operate as an electronic periscope. For embodiments in which the apparatus also includes the antennas described above in conjunction with FIG. 5, the electronic assembly 31 of FIG. 2 can include one or more radio elements 132, for example, one or more of an Iridium radio, a UHF radio, a GPS system, and AIS system, and a radar detection system, each coupled to a respective one of the antennas described in conjunction with FIG. 5 above and FIG. 7 below.

When one or more of the systems 132 are included, the image processor 78 can include a combining module 126 configured to combine the stabilized panoramic signal 114 with signals 130 to and/or from one or more of the radio elements 132. The combining module 126 can generate a combined signal 128, which combined signal can couple to the optical converter 112, in which case the signal 114 is a combined optical signal having information to/from all of the combined elements 132 and also having the optical stabilized panoramic signal.

The optical stabilized panoramic signal 114 or the combined signal 114 can be the same as or similar to the stabilized signal 88 of FIG. 6.

Figure 8:
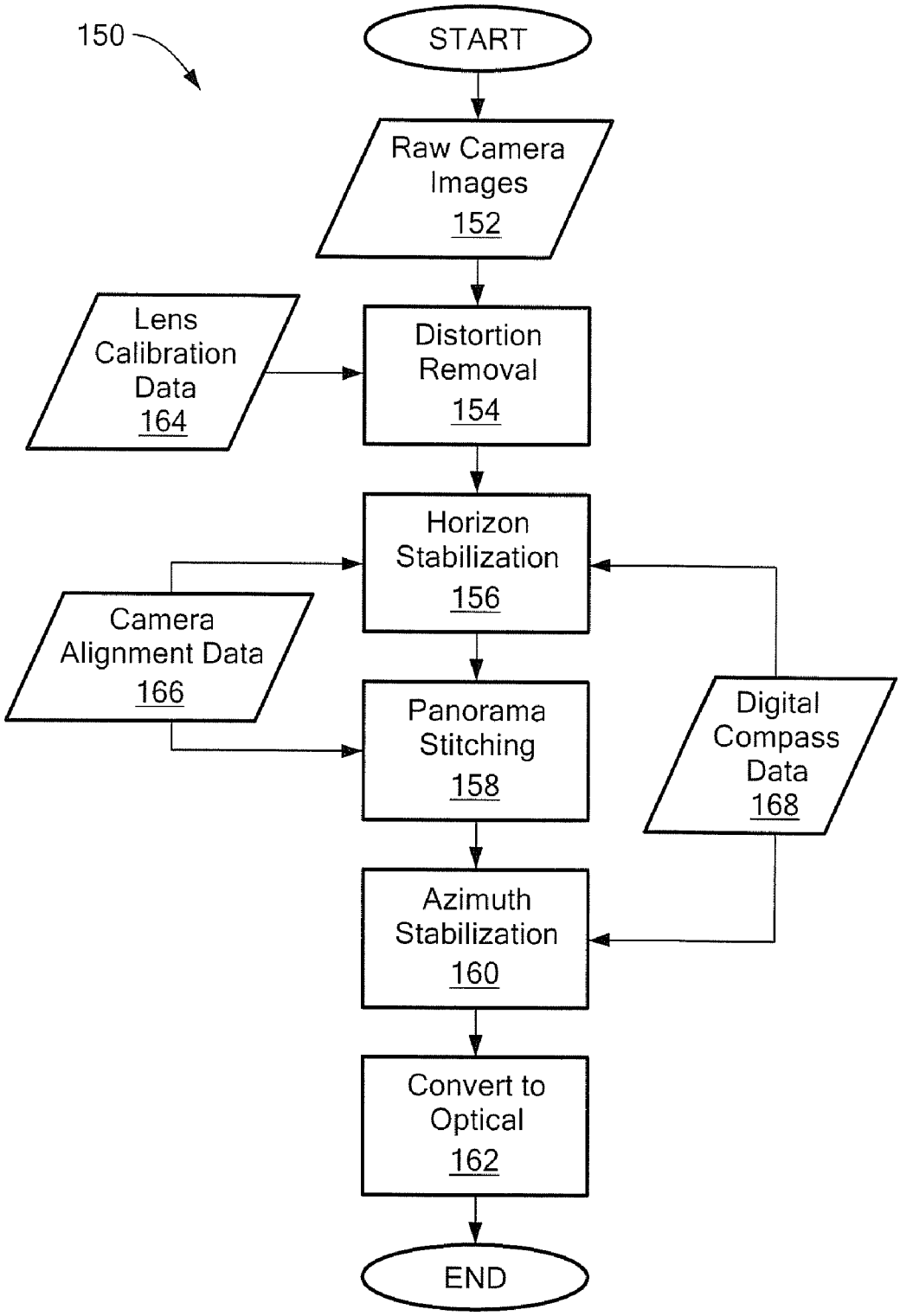
FIG. 8 is a flow chart showing a computer-implemented method that can be implemented by the image processor of FIGS. 6 and 7.

It should be appreciated that FIG. 8 shows a flowchart corresponding to the below contemplated technique which would be implemented in the image processor of FIG. 6. Rectangular elements (typified by element 152 in FIG. 8), herein denoted "processing blocks," represent computer software instructions or groups of instructions. Diamond shaped elements, of which there are none, herein denoted "decision blocks," represent computer software instructions, or groups of instructions, which affect the execution of the computer software instructions represented by the processing blocks.

Alternatively, the processing and decision blocks represent steps performed by functionally equivalent circuits such as a digital signal processor circuit or an application specific integrated circuit (ASIC). The flow diagrams do not depict the syntax of any particular programming language. Rather, the flow diagrams illustrate the functional information one of ordinary skill in the art requires to fabricate circuits or to generate computer software to perform the processing required of the particular apparatus. It should be noted that many routine program elements, such as initialization of loops and variables and the use of temporary variables are not shown. It will be appreciated by those of ordinary skill in the art that unless otherwise indicated herein, the particular sequence of blocks described is illustrative only and can be varied without departing from the spirit of the invention. Thus, unless otherwise stated the blocks described below are unordered meaning that, when possible, the steps can be performed in any convenient or desirable order.

Referring now to FIG. 8, a process 150 begins at block 152 where raw camera images are collected, for example, from the electronic cameras 70*a*-70*c* of FIGS. 6 and 7. The raw images correspond to the electronic camera signals 76*a*-76*d* of FIGS. 6 and 7.

At block 154, distortion is removed, for example, as described above in conjunction with the distortion removal module 100 of FIG. 7, resulting in distortion corrected signals (e.g., 100*a*-100*d*, FIG. 7).

At block 156, the horizon is stabilized, i.e., the images are stabilized in pitch and roll, for example, as described above in conjunction with the pitch and roll stabilization module 102 of FIG. 7, resulting in pitch and roll stabilized signals (e.g., 102*a*-102*d*, FIG. 7).

At block 158, the pitch and roll stabilized signals (e.g., 102*a*-102*d*, FIG. 7) associated with the individual electronic cameras 70*a*-70*d* (FIGS, 6 and 7) are stitched together forming a panorama, for example, as described above in conjunction with the panorama generation module 104 of FIG. 7, resulting in a panoramic signal (e.g., 106, FIG. 7).

At block 160, the panorama (e.g., 108, FIG. 7) is stabilized in rotation about the azimuth, for example, as described above in conjunction with the azimuth stabilization module 108 of FIG. 7, resulting in a stabilized panoramic signal (e.g., 110, FIG. 7).

At block 162, the stabilized panoramic signal is converted to an optical signal (e.g., 114, FIG. 7) to be carried on the optical fiber cable 22 of FIGS. 1 and 2.

Lens calibration data values 164 (e.g., 118, FIG. 7) are provided to block 154 and camera alignment data values 166 (e.g., 122) are provided to blocks 156 and 158.

Referring now to FIG. 9, in which like elements of FIGS. 1 and 2 have like reference designations, an apparatus 170 includes the tubular structure 3 of FIGS. 1 and 2. However, instead of the inflatable bag 1 of FIGS. 1 and 3, the apparatus 170 includes a cylindrical buoyant structure 172 to which the electronic camera assembly 20 is coupled. In some embodiments, the cylindrical buoyant structure 172 is coupled rigidly or nearly rigidly to the tubular structure 3.

The apparatus 170 would behave like a spar buoy subject in particular to an unacceptable amount of rotation about a central vertical axis 172*a*, however, the apparatus 170 also includes features, i.e., fin members 174*a*, 174*b*, that prevent substantial and rapid rotation of the apparatus 170. As described below in conjunction with FIGS. 10-12A, the fin members 174*a*, 174*b* can take a variety of forms, each form acting as one or more fins.

Prior to deployment of the apparatus 170, the buoyant structure 172 can be contained within the compartment 33. Upon deployment, by way of its own buoyancy, the buoyant structure 172, a cylindrical buoy, can move upward relative to the tubular structure 3, and the compartment 33 can flood with water through the holes 14. An end 172*a* of the buoyant structure 172 can remain within the compartment 33, retained to the tubular structure 3 with a cord or the like.

In some other embodiments, the buoyant structure 172 deploys to a position entirely outside of the compartment 33 and the apparatus 170 can include the bumper 39 of FIG. 2. In these embodiments, the tubular structure 3 can tilt relative to the buoyant structure 172 by at least ten to fifteen degrees before contact between the tubular structure 3 and the bumper 39.

While the fin members 174*a*, 174*b* are shown to be coupled to the tubular structure 3, in other embodiments, the fin members 174*a*, 174*b* can be coupled instead to the cylindrical buoy 172.

Figure 10:
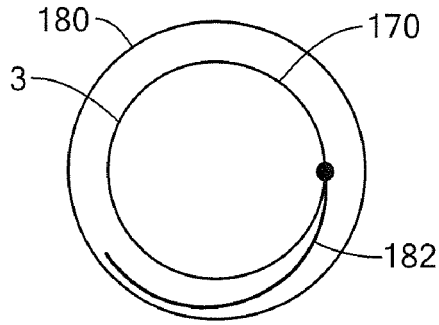
FIG. 10 is a top view of a particular arrangement of an apparatus like the apparatus of FIG. 9 when contained within a launch tube.

Referring now to FIG. 10, in which like elements of FIGS. 1 and 2 have like reference designations, an exemplary feature 182, which can provide the functions of the fin members 174*a*, 174*b* of FIG. 9, is stowed about the tubular structure 3 when within a launch tube 180. In some embodiments, the feature 182 is held more tightly to the tubular structure 3 than is shown. For example, in some embodiments, the feature is held with water-soluble tape.

For above-described alternate embodiments for which the feature 182 is coupled to the buoyant structure 172 of FIG. 9 rather than to the tubular structure 3, the feature 182 can be retained within the compartment 33 of the tubular structure 3 when stowed prior to deployment.

Figure 10A:
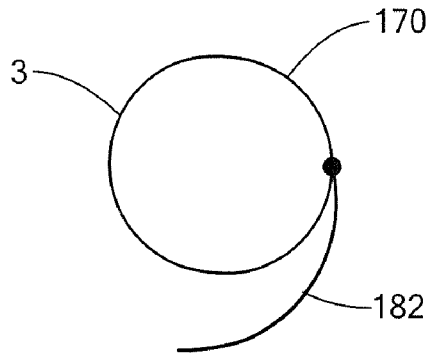
FIG. 10A is a top view of the apparatus of FIG. 10 when deployed.

Referring now to FIG. 10A, in which like elements of FIGS. 1 and 2 have like reference designations, the feature 182 takes a deployed shape, springing outward from the tubular structure 3, when the apparatus 170 is out of the launch tube 180 and/or when the buoyant structure 172 of FIG. 9 is out of the compartment 33.

Figure 11:
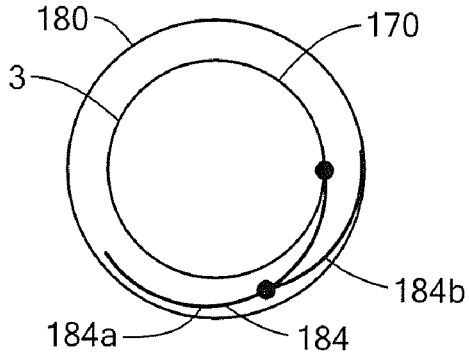
FIG. 11 is a top view of another particular arrangement of an apparatus like the apparatus of FIG. 9 when contained within a launch tube.

Referring now to FIG. 11, in which like elements of FIGS. 1 and 2 have like reference designations, another exemplary feature 184, which can provide the functions of the fin members 174*a*, 174*b* of FIG. 9, is stowed about the tubular structure 3 when within a launch tube 180. The feature 184 can have joined portions 184*a*, 184*b*. In some embodiments, the feature 184 is held more tightly to the tubular structure 3 than is shown. For example, in some embodiments, the feature 184 is held with water-soluble tape.

Figure 11A:
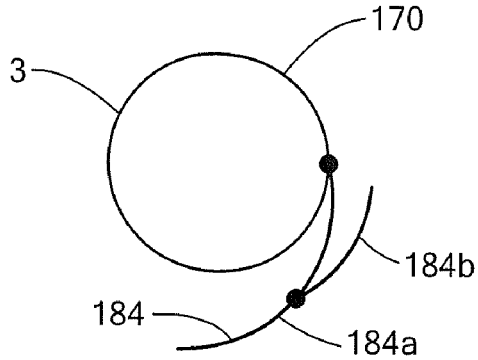
FIG. 11A is a top view of the different buoyant structure of FIG. 11 when deployed.

Referring now to FIG. 11A, in which like elements of FIGS. 1 and 2 have like reference designations, the feature 184 takes a deployed shape, springing outward from the tubular structure 3, when the apparatus 170 is out of the launch tube 180.

Figure 12:
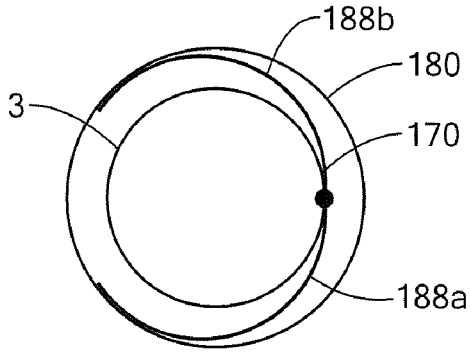
FIG. 12 is a top view of yet another particular arrangement of an apparatus like the apparatus of FIG. 9 when contained within a launch tube.

Referring now to FIG. 12, in which like elements of FIGS. 1 and 2 have like reference designations, other exemplary features 188*a*, 188*b*, which can provide the functions of the fin members 174*a*, 174*b* of FIG. 9, are stowed about the tubular structure 3 when within a launch tube 180. In some embodiments, the features 188*a*, 188*b* are held more tightly to the tubular structure 3 than is shown. For example, in some embodiments, the features 188*a*, 188*b* are held with water-soluble tape.

Figure 12A:
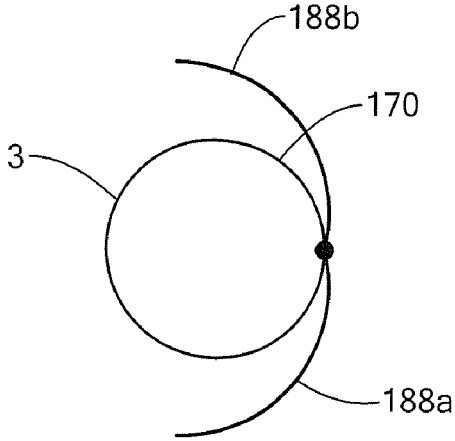
FIG. 12A is a top view of the different buoyant structure of FIG. 12 when deployed.

Referring now to FIG. 12A, in which like elements of FIGS. 1 and 2 have like reference designations, the features 188*a*, 188*b* take a deployed shape, springing outward from the tubular structure 3, when the apparatus 170 is out of the launch tube 180. It will be apparent that the features 188*a*, 188*b* can be the same as or similar to the fin members 174*a*, 174*b* of FIG. 9

Figure 13:
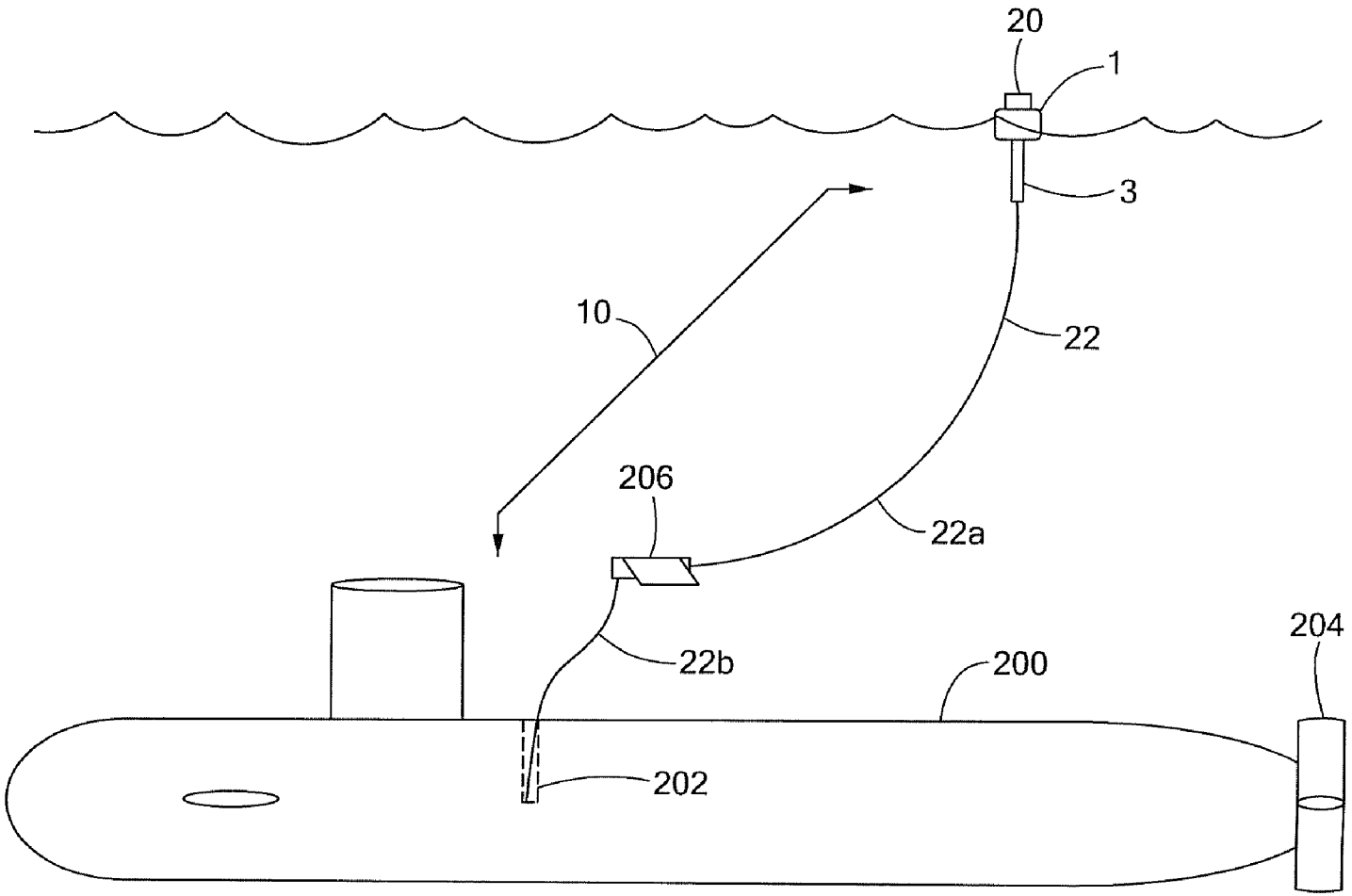
FIG. 13 is a pictorial of the apparatus of FIG. 1 or 9 as coupled to and deployed from a submarine.

Referring now to FIG. 13, in which like elements of FIGS. 1 and 2 have like reference designations, the apparatus 10 of FIGS. 1-3 (or the apparatus 170 of FIG. 9) is shown coupled to a submarine 200 having a launch tube 202. As described above, the apparatus 10 can function at least as an electronic periscope, allowing, by way of the electronic camera assembly 20, a panoramic surface view of the area surrounding the submarine 200. Also as described above, the apparatus 10 can have one or more radio elements, which can provide one or more of the functions described above in conjunction with FIGS. 5 and 7.

In some embodiments, the launch tube 202 is a conventional submarine launch tube, conventionally used for deployment of communication type buoys.

A lift body 206 can be coupled to the fiber optic cable 22, here indicated to have two portions 22*a*, 22*b*, in order to lift the fiber optic cable up and away from the submarine, and in particular, up and away from a propeller 204. The lift body can be the same as or similar to a lift body described in U.S. patent application Ser. No. 11/613,426, filed Dec. 20, 2006, which application is incorporated by reference herein in its entirety.

In some embodiments, the portions 22*a*, 22*b* of the fiber optic cable 22 are coupled together at the lift body 206.

In some embodiments, at least the portion 22*a* is deployed from a spool within the lift body and 206. In some embodiments, the portion 22*a* can be more than one kilometer long, for example, five kilometers long. In some embodiments, the portion 22*a* deploys from the lift body 206 as the submarine moves through the water and while the buoyant structure 1 is on the surface of the water, resulting in minimal tension upon the portion 22*a*. Once the portion 22*a* is fully deployed, one or both of the portions 22*a*, 22*b* can be automatically cut.

In other embodiments, the portion 22*a* is deployed from a spool within the tubular structure 3.

All references cited herein are hereby incorporated herein by reference in their entirety. Having described preferred embodiments of the invention, it will now become apparent to one of ordinary skill in the art that other embodiments incorporating their concepts may be used. It is felt therefore that these embodiments should not be limited to disclosed embodiments, but rather should be limited only by the spirit and scope of the appended claims.

What is claimed is:

1. Apparatus comprising:

a buoyant structure having a central vertical axis when floating in water and having at least one feature to reduce a rotation of the buoyant structure about the central vertical axis when floating in the water;

an electronic camera assembly coupled to the buoyant structure, wherein the electronic camera assembly is configured to generate an electronic image signal;

a tubular structure coupled to the buoyant structure and configured to remain under the surface of the water, wherein the tubular structure comprises:

a watertight compartment; and an electronic circuit assembly disposed within the watertight compartment, wherein the electronic circuit assembly is coupled to receive the electronic image signal, wherein the electronic circuit assembly is configured to generate an optical image signal representative of the electronic image signal; and a fiber optic cable coupled to the electronic circuit assembly and configured to carry the optical image signal, wherein the at least one feature to reduce a rotation of the buoyant structure comprises a virtual mass of water disposed proximate to an outer sidewall of the buoyant structure, wherein the electronic camera assembly includes a plurality of cameras, each camera pointing toward a different azimuth angle, and wherein the electronic image signal includes signals from each one of the plurality of electronic cameras, wherein the apparatus further comprises:

an image processor configured to provide image stabilization to the signals from each one of the plurality of electronic cameras as the buoyant structure moves in at least one degree of motion.

2. The apparatus of claim 1, further comprising a flexible coupling structure coupled between the buoyant structure and the tubular structure, wherein the flexible coupling structure retains the tubular structure to the buoyant structure, and wherein the flexible structure allows angular movement between the buoyant structure and the tubular structure.

3. The apparatus of claim 2, wherein the flexible coupling structure comprises a bumper to limit the angular movement between the buoyant structure and the tubular structure, wherein the bumper is comprised of a material selected to reduce damage to the buoyant structure throughout a full range of the angular movement.

4. The apparatus of claim 1, wherein the electronic image signal corresponds to a video image signal representative of a moving image.

5. The apparatus of claim 4, wherein the image stabilization provides a stable video image signal representative of a stable view about the buoyant structure as the buoyant structure moves in at least one degree of motion.

6. The apparatus of claim 4, wherein the image stabilization provides a stable video image signal representative of a stable panoramic view azimuthally about the buoyant structure as the buoyant structure moves in at least one degree of motion.

7. The apparatus of claim 5, further comprising a flexible coupling structure coupled between the buoyant structure and the tubular structure, wherein the flexible coupling structure retains the tubular structure to the buoyant structure, and wherein the flexible structure allows angular movement between the buoyant structure and the tubular structure.

8. The apparatus of claim 7, wherein the flexible coupling structure comprises a bumper comprised of a material selected to reduce damage to the buoyant structure throughout a full range of the angular movement.

9. The apparatus of claim 7, wherein the buoyant structure comprises:

a central structure having an outer side wall coupled between upper and lower opposing surfaces, wherein the buoyant structure is configured to float in water such that a top portion of the central structure is above a surface of the water and a lower portion of the central structure is below the surface of the water;

a damper skirt having upper and lower opposing surfaces and an outer circumferential edge between the upper and lower opposing surfaces, wherein the upper surface of the damper skirt is coupled to the lower surface of the central structure, wherein an outer region of the damper skirt extends outward beyond the outer side wall of the central structure; and a ribbon fence coupled to the outer side wall of the central structure at a plurality of attachment regions and also coupled to and extending upward from the outer region of the damper skirt, wherein the ribbon fence surrounds a substantial part of the lower portion of the central structure, wherein the ribbon fence is configured to entrain water to form the virtual mass of water, wherein the at least one feature to reduce a rotation of the buoyant structure comprises the virtual mass of water.

10. The apparatus of claim 9, wherein the central structure comprises an inflatable bag.

11. The apparatus of claim 10, further comprising an inflation mechanism coupled to the inflatable bag, wherein the inflatable bag is configured to stow into the tubular structure before inflation and to deploy from the tubular structure and to inflate in response to an activation of the inflation mechanism.

12. The apparatus of claim 11, wherein the tubular structure is configured to fit within a submarine launch tube before inflation of the inflatable bag.

13. The apparatus of claim 9, wherein the buoyant structure comprises a plurality of compartments, each compartment bounded by the ribbon fence, bounded by the outer side wall of the central structure, and bounded by the outer region of the damper skirt, each compartment having an upper opening, each compartment having a hole below the upper opening such that water can enter and leave each compartment through the hole, wherein the buoyant structure is configured to float in the water such that each hole is beneath the surface of the water allowing each compartment to at least partially fill with water, wherein water within each respective compartment forms the virtual mass of water.

14. The apparatus of claim 13, wherein the damper skirt is concave upward in a direction of the surface of the water, wherein the buoyant structure is configured to float such that a substantial portion of the damper skirt is below the surface or the water.

15. The apparatus of Claim 5, wherein the plurality of electronic cameras comprises at least four electronic cameras.

16. The apparatus of claim 5, wherein the plurality of electronic cameras comprises at least six electronic cameras.

17. The apparatus of claim 5, wherein each electronic camera includes a lens having a focal length, wherein the focal length is selected to achieve an azimuth viewing angle so that a ship at a horizon range from the apparatus occupies at least one pixel associated with at least one of the plurality of cameras.

18. The apparatus of claim 5, wherein a number of electronic cameras within the plurality of electronic cameras is selected to achieve an uninterrupted three hundred sixty degree azimuth viewing range.

19. The apparatus of claim 5, wherein the buoyant structure further comprises at least one antenna supported within the central structure.

20. The apparatus of claim 19, wherein the at least one antenna is configured to operate in a respective at least one of: a frequency band associated with an ultra high frequency (UHF) radio, a frequency band associated with an Iridium radio, a frequency band associated with an automatic identification system (AIS), a frequency band associated with a radar detection system, or a frequency band associated with a global positioning system (GPS).

21. The apparatus of claim 5, wherein the electronic circuit assembly within the tubular structure comprises at least a portion of a respective at least one of an ultra high frequency (UHF) radio, an Iridium radio, an automatic identification system (AIS), a radar detection system, or a global positioning system (GPS).

22. The apparatus of claim 5, wherein the tubular structure is configured to fit within a submarine launch tube.

23. The apparatus of claim 5, wherein the buoyant structure comprises a cylindrical buoy having the central vertical axis when floating in water, wherein the at least one feature further comprises a respective at least one fin member coupled to an outer surface of at least one of the cylindrical buoy or the tubular structure that extends in a direction outward from the central vertical axis at a position so as to be substantially under the surface of the water when the cylindrical buoy is floating in the water, wherein the at last one fin member is configured to fold circumferentially around the at least one of the cylindrical buoy or the tubular structure, and wherein the fin member is configured to automatically extend when the apparatus is deployed.

24. The apparatus of claim 23, wherein the plurality of electronic cameras comprises at least four electronic cameras.

25. The apparatus of claim 23, wherein the plurality of electronic cameras comprises at least six electronic cameras.

26. The apparatus of claim 23, wherein each electronic camera includes a lens having a focal length, wherein the focal length is selected to achieve an azimuth viewing angle so that a ship at a horizon range from the apparatus occupies at least one pixel associated with at least one of the plurality of cameras.

27. The apparatus of claim 23, wherein a number of electronic cameras within the plurality of electronic cameras is selected to achieve an uninterrupted three hundred sixty degree azimuth viewing range.

28. Apparatus comprising:

a buoyant structure having a central vertical axis when floating in water and having at least one feature to reduce a rotation of the buoyant structure about the central vertical axis when floating in the water, wherein the buoyant structure comprises a cylindrical buoy having the central vertical axis when floating in water, wherein the at least one feature comprises a respective at least one fin member coupled to an outer surface of at least one of the cylindrical buoy or the tubular structure that extends in a direction outward from the central vertical axis at a position so as to be substantially under the surface of the water when the cylindrical buoy is floating in the water, wherein the at last one fin member is configured to fold circumferentially around the at least one of the cylindrical buoy or the tubular structure, and wherein the fin member is configured to automatically extend when the apparatus is deployed;

an electronic camera assembly coupled to the buoyant structure, wherein the electronic camera assembly is configured to generate an electronic image signal;

a tubular structure coupled to the buoyant structure and configured to remain under the surface of the water, wherein the tubular structure comprises:

a watertight compartment; and an electronic circuit assembly disposed within the watertight compartment, wherein the electronic circuit assembly is coupled to receive the electronic image signal, wherein the electronic circuit assembly is configured to generate an optical image signal representative of the electronic image signal; and a fiber optic cable coupled to the electronic circuit assembly and configured to carry the optical image signal.

* * * * *

UNITED STATES PATENT AND TRADEMARK OFFICE

CERTIFICATE OF CORRECTION

PATENT NO. : 7,862,394 B2
APPLICATION NO. : 12/422617
DATED : January 4, 2011
INVENTOR(S) : Larson et al.

It is certified that error appears in the above-identified patent and that said Letters Patent is hereby corrected as shown below:

On title page

Page 1, item (73) Assignee: replace "Ultra Electronics Ocean Systems, Inc., Braintree, MA (US)"
with --Ultra Electronics Ocean Systems, Inc., Braintree, MA (US)
Areté Associates, Sherman Oaks, CA (US)--.

Signed and Sealed this
Twenty-eighth Day of June, 2011

David J. Kappos

David J. Kappos
*Director of the United States Patent and Trademark Office*